US006574584B2

(12) United States Patent
Yeung et al.

(10) Patent No.: US 6,574,584 B2
(45) Date of Patent: Jun. 3, 2003

(54) METHOD FOR EVALUATING COMPRESSOR STALL/SURGE MARGIN REQUIREMENTS

(75) Inventors: Chung-Hei Yeung, Niskayuna, NY (US); Joseph Anthony Cotroneo, Clifton Park, NY (US); John David Stampfli, Greer, SC (US)

(73) Assignee: General Electric Company, Niskayuna, NY (US)

( * ) Notice: Subject to any disclaimer, the term of this patent is extended or adjusted under 35 U.S.C. 154(b) by 224 days.

(21) Appl. No.: 09/732,811

(22) Filed: Dec. 11, 2000

(65) Prior Publication Data

US 2002/0072876 A1 Jun. 13, 2002

(51) Int. Cl.[7] ..... G06F 15/00; G06F 11/30

(52) U.S. Cl. ..... 702/179; 702/182; 73/116; 700/287

(58) Field of Search ..... 702/33–35, 43, 702/45, 47, 50, 109, 113, 114, 138, 140, 179, 181–185; 60/795; 73/116, 168; 415/13, 14, 17, 26, 47; 700/287, 289

(56) References Cited

U.S. PATENT DOCUMENTS 3,979,655 A * 9/1976 Rutshtein et al. ..... 290/52
5,165,844 A * 11/1992 Khalid ..... 415/17
5,165,845 A * 11/1992 Khalid ..... 415/17
5,344,284 A * 9/1994 Delvaux et al. ..... 415/173.2
5,448,881 A * 9/1995 Patterson et al. ..... 415/26
5,548,539 A * 8/1996 Vlach et al. ..... 703/13
6,164,902 A * 12/2000 Irwin et al. ..... 415/118

* cited by examiner

*Primary Examiner*—Marc S. Hoff
*Assistant Examiner*—Manuel L. Barbee
(74) *Attorney, Agent, or Firm*—John F. Thompson; Patrick K. Patnode

(57) ABSTRACT

A method is provided for evaluating stall/surge margin of a machine of interest. The method includes identifying a vital factor where each the vital factors corresponds to operation of the machine of interest. Raw data relating to the vital factor is provided. A contribution of the vital factor to the stall/surge margin is determined from at least the provided raw data. The contribution of the vital factor to the stall/surge margin is statistically analyzed. A stall/surge margin is allocated based on the statistical analysis of the contribution of the vital factor. An operating limit line is defined based on the allocation of the stall/surge margin.

23 Claims, 3 Drawing Sheets

METHOD FOR EVALUATING COMPRESSOR STALL/SURGE MARGIN REQUIREMENTS

BACKGROUND OF THE INVENTION

The present invention relates to a method and software for evaluating compressor stall/surge margin requirements and more particularly to using statistical analysis to identify the contribution each vital factor has on the compressor stall/surge margin requirements.

Efficient power generation equipment is highly in demand. Preferred power generation equipment consists of a gas turbine combined-cycle power plant utilizing a gas-turbine topping cycle and a Rankine-based bottoming cycle. This type of power generation equipment is preferred because of low costs and the continually improving operating efficiency of the gas turbine based combined cycle that leads to reduce the cost of the power produced.

These preferred industrial gas turbine systems are operated to achieve the goals of minimal parts count, operational simplicity, overall low costs, high combined cycle efficiency and high power output. An increase in the combined-cycle efficiency and power generated can be accomplished by elevating the firing temperature. For a given firing temperature, an optimal cycle pressure ratio exists that maximizes the combined-cycle efficiency. The optimal cycle pressure ratio, theoretically, trends higher with increasing firing temperature.

Typically in industrial gas turbine systems, axial compressors are subjected to the demand for increased pressure ratios. In addition, the compressor must also perform in an aerodynamically and mechanically stable manner over a wide range of mass flow rates that are associated with the varying power output characteristics of combined-cycle industrial gas turbine operation.

To meet these demands of the compressor, the operating compressor pressure ratio of an industrial gas turbine is typically set to a pre-specified margin away from the surge/stall boundary, know as the stall/surge margin. This margin is designed to avoid unstable compressor operation.

Conventionally, the stall/surge margin of the compressor is evaluated by identifying a list of factors that contribute to the stall/surge margin during operation of the industrial gas turbine system. The standard deviations of the individual factors are combined using root-sum-squares to determine the overall stall/surge margin standard deviation. The variability of the stall/surge margin can be caused by either variation from build to build or variation within any single industrial gas turbine system. The resulting overall stall/surge margin standard deviation is then multiplied by a risk factor that gives a determined stall/surge margin that has a low probability of a surge. Typically, the stall/surge margin represents a region where the industrial gas turbine system operates at a high efficiency with a very low probability for a surge. In conventional industrial gas turbines, once the stall/surge margin is determined, it is not modified over operational time or the operating conditions of the industrial gas turbine system.

Therefore, it is desired to determine the operational characteristics of an industrial gas turbine system that allow operation at the highest operational efficiency, with the highest power output and with low probability of a surge or stall. To achieve these operational goals, it is also desired to determine a stall/surge margin that allows the operating pressure ratio to be as close as possible to the surge/stall boundary. To ensure efficient and unproblematic operation in this region, it is further desired that each of the factors be accurately evaluated to determine the contribution of each factor on the stall/surge margin. In addition, it is desired that adjustment of the stall/surge margin be performed during operation of the industrial gas turbine system based on the evaluation of the each factor.

BRIEF SUMMARY OF THE INVENTION

In one exemplary embodiment, a method for evaluating stall/surge margin for a machine of interest is provided. The method includes inputting data relating to desired operating conditions of the machine of interest. A plurality of vital factors is identified where each of the plurality of vital factors corresponds to the operation of the machine of interest. At least one of the plurality of vital factors is selected. Raw data relating the selected at least one of the plurality of vital factors is provided. A contribution of the selected at least one of the plurality of vital factors to the stall/surge margin is determined from at least the provided raw data and the input data related to the desired operating conditions of the machine of interest. The contribution of the plurality of vital factors to the stall/surge margin is statistically analyzed. A stall/surge margin is allocated based on the statistical analysis of the plurality of vital factors. An operating limit line is defined based on the allocation of the stall/surge margin.

In another exemplary embodiment, a computer readable medium is provided that contains instructions for controlling a computer system to perform a method. The method includes inputting data relating to desired operating conditions of the machine of interest. A plurality of vital factors are identified where each of the plurality of vital factors corresponds to the operation of the machine of interest. At least one of the plurality of vital factors is selected. Raw data relating the selected at least one of the plurality of vital factors is provided. A contribution of the selected at least one of the plurality of vital factors to the stall/surge margin is determined from at least the provided raw data and the input data related to the desired operating conditions of the machine of interest. The contribution of the plurality of vital factors to the stall/surge margin is statistically analyzed. A stall/surge margin is allocated based on the statistical analysis of the plurality of vital factors. An operating limit line is defined based on the allocation of the stall/surge margin.

DETAILED DESCRIPTION OF THE INVENTION

Figure 1:
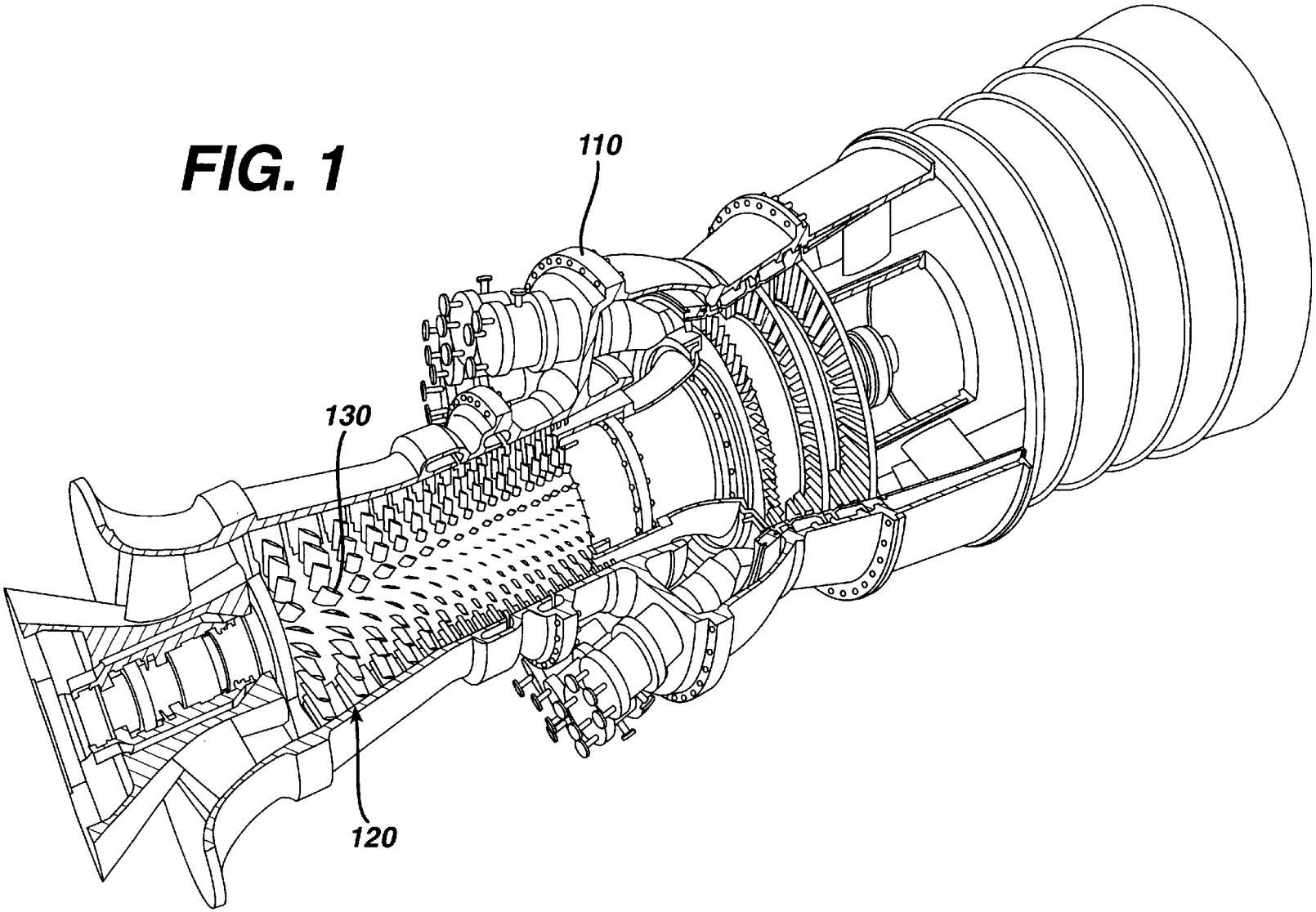
FIG. 1 is a perspective, cut-away view of one exemplary embodiment of an industrial gas turbine system.

In one embodiment as shown in FIG. 1, an industrial gas turbine 110 is used as part of a combined cycle configuration that also includes, for example, steam turbines (not shown) and other generators (not shown) to generate an electrical power output from the combustion of natural gas or other combustible fuel. In one exemplary embodiment, the operation of a combined cycle system uses an industrial gas turbine 110 based topping cycle and a Rankine based bottoming cycle. In another embodiment, the industrial gas turbine 110 can include a generator (not shown) to form a simple cycle system. In either the combined or simple cycle system, it is a desirable goal to operate the industrial gas turbine 110 at the highest operating efficiency to produce the high electrical power output at a relatively low cost. The operating efficiency of an industrial gas turbine 110 operating when using a gas turbine combined cycle is found to be directly proportional to the firing temperature. Therefore, as the firing temperature increases, the operating efficiency also increases.

To operate the industrial gas turbine 110 at higher firing temperatures, the cycle pressure ratio has been determined to also increase with increasing firing temperatures. Thus, as the firing temperature is increased to increase the operational efficiency of the industrial gas turbine 110, the cycle pressure ratio also increases. The compressor 120 of the industrial gas turbine 110 maintains the cycle pressure ratio. Therefore, an increase in the cycle pressure ratio causes the compressor 120 to work harder to produce the desired cycle pressure that is required for the efficient operation of the industrial gas turbine 110.

Figure 2:
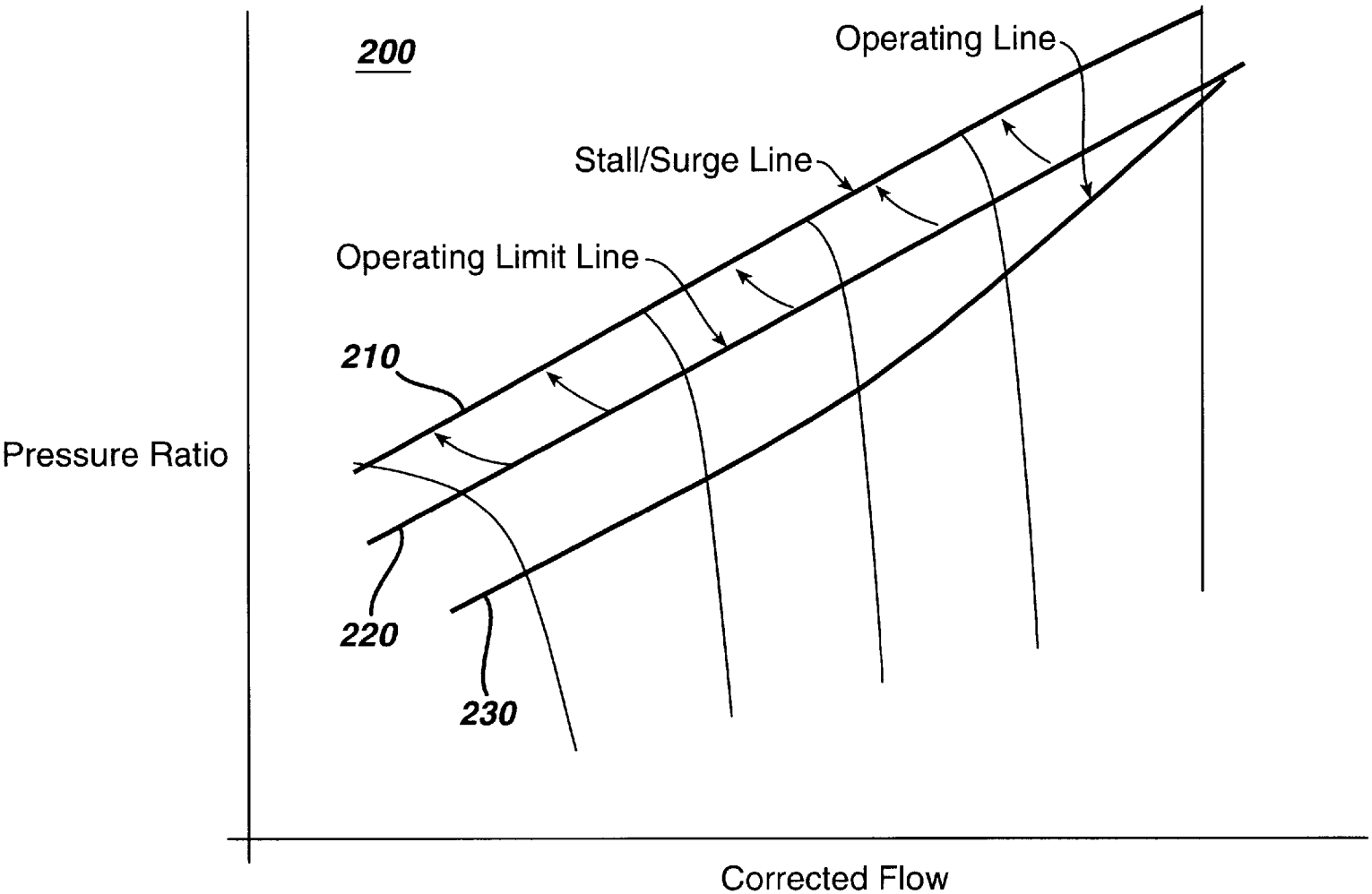
FIG. 2 is a graph illustrating various operating conditions of an industrial gas turbine system.

As such in a highly efficient industrial turbine system, the compressor 120 should be operated to produce a cycle pressure ratio that corresponds to a high firing temperature. However, the compressor 120 can experience aerodynamic instabilities, such as, for example, a rotating stall and/or surge, as the compressor 120 is used to produce the high firing temperatures and/or the high cycle pressure ratios. It should be appreciated that a compressor 120 that experiences a stall and/or surge can cause problems that adversely affect the components and/or the operational efficiency of the industrial gas turbine 110. The operation of the compressor 120 should be maintained within an operational region that does not cause the industrial gas turbine 110 to stall and/or surge or operate in a problematic manner. In FIG. 2, a turbine operation graph 200 illustrates various operational regions of the compressor 120 of the industrial gas turbine 110. The turbine operation graph 200 includes a stall/surge line 210 representing the limit where the compressor 120 can safely operate without the occurrence of a surge and/or stall. Theoretically, the industrial gas turbine 110 will operate at the highest efficiency possible if operation is maintained as close to the stall/surge line 210 as possible without going beyond the stall/surge line 210 to cause a surge or a stall. Therefore, to ensure that a surge or stall and/or other problematic operation of the industrial gas turbine 110 does not occur, an operating limit line 220, above which operation is not allowed, is set at a predetermined operating risk factor away from the stall/surge line 210.

In addition, in FIG. 2, a conventional operating line 230 is shown that illustrates a region where the industrial turbine system can be operated. The location of the operating line 230 depends on the various components of the industrial gas turbine 110 as well as the location of the operating limit line 220. The operating line 230 represents the aerodynamic-thermodynamic equilibrium of the industrial turbine system given the industrial gas turbine 110 components. The operating limit line 220 represents the absolute maximum aerodynamic load, also referred to as pressure ratio, beyond which the compressor 120 will not operate safely. Any deviation of the operating limit line 220 from the surge/stall line 210 and any deviation of the operating line 230 from the operating limit line 220 implies that the industrial gas turbine 110 can allow an increase in the pressure ratio and/or the operational efficiency. In one exemplary embodiment, to increase the operational efficiency of the industrial gas turbine, the operating limit line 220 is moved toward the stall/surge line 210 by identifying and statistically analyzing vital factors that affect the operating risks associated with the placement of the operating limit line 220 given a surge/stall line 210. With the operating limit line 220 closer to the surge/stall line 210, the various components of the gas turbine 110 can be designed such that the operating line 230 is closer to the operating limit line 220, hence realizing higher operational efficiency and increased power output.

Figure 3:
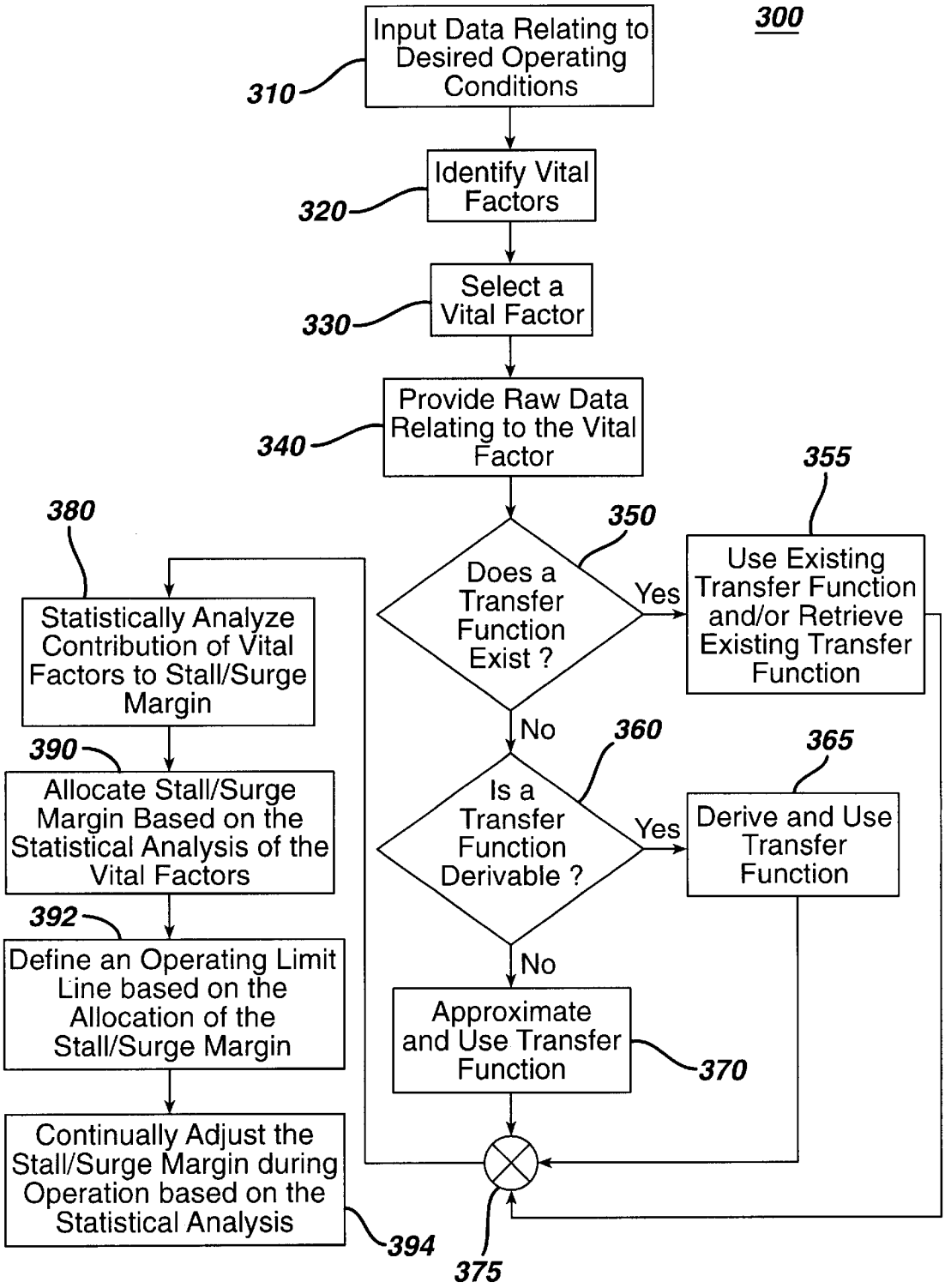
FIG. 3 is a flow chart of one exemplary embodiment of a method for evaluating stall/surge margin.

In one exemplary embodiment as shown in FIG. 3, a method 300 is provided that identifies and statistically analyzes vital factors that affect the positioning of the operating limit line 220 (FIG. 2) for safe operations. The statistical analysis of the vital factors allows the risk of stall/surge to be evaluated before determination of the operating limit line 220. It should be appreciated that, in another embodiment, one or more of the vital factors can be continually monitored and operating limit line 220 adjusted during operation of the industrial gas turbine 110 so that the conventional operating line 230 (FIG. 2) can be moved as close as possible to the operating limit line 220 (FIG. 2) without compromising the safe operation of the industrial gas turbine 110. In one embodiment of the method 300 as shown in FIG. 3, the method 300 can be implemented via software or a program stored, for example, in the memory (not shown) of a computer (not shown). It should be appreciated that in one embodiment of the method 300 the software can be made in a variety of formats, such as, for example, an electronic database worksheet, visual basic code or other computer programming codes. It should also be appreciated that the software of one format, such as, for example, an electronic database worksheet, can call a subroutine of another format, such as, for example, a visual basic program, to perform analysis on various data inputs.

As shown in FIG. 3, an exemplary embodiment of method 300 includes inputting data relating to the desired operating conditions (step 310). The input of data (step 310) relates to the overall or nominal operational characteristics of the industrial gas turbine 110. In one embodiment, the data relating to the desired operating conditions comprises, for example, corrected speed (in percent), variable stator vane setting, number of stages and nominal stall/surge margin (in percent). The corrected speed (in percent) refers to the equivalent physical speed adjusted for density differences in air as a function of temperature. The compressor 120 in industrial gas turbine 110 has inlet guide vanes 130. The inlet guide vanes 130 are placed at the inlet of the compressor 120 to guide the air flow into the main core of the compressor 120 at the appropriate aerodynamic setting.

To begin the evaluation, in one embodiment, a nominal stall/surge margin (in percent) can be assumed. The assumption of a nominal stall/surge margin can be included as part of a step of inputting data relating to desired operating conditions (step 310). After the data has been input (step 310), the method 300 includes identifying vital factors relating to the operation of the industrial gas turbine 110 (step 320). More specifically, the vital factors relate to the determination of the stall/surge line 210 (FIG. 2) as well as providing information relating to uncertainties that can arise during operation as identified by various sensors and actuators attached to the industrial gas turbine 110. In one embodiment, the vital factors can comprise, for example, cold buildup clearance that relates to a distance between the tip of a compressor blade and the inner wall of the compressor 120 casing when the industrial gas turbine 110 is not being operated.

Tip loss and casing gouge, also referred to as tip rubs, can be a vital factor. When a industrial gas turbine 110 is operated, thermodynamic and aerodynamic effects of the operation results in slight changes in the shape and dimensions of, among other parts, the compressor blades and casing. These shape and dimensional changes result in a change of the tip clearance. This change often results in the compressor blades touching and rubbing against the inner wall of the compressor 120 casing. This phenomenon is referred to as tip rubs. Tip rubs can cause material to be lost from the compressor blades (tip loss), and the casing material being ground away (casing gouge).

Unit blade quality can be a vital factor and refers to the variation of the making and setting of each individual compressor blade. Inlet temperature sensing can be a vital factor and relates to the inlet temperature that is used to adjust the physical speed to obtain the corrected speed. Once obtained, the corrected speed is used by a control system to control activities. For example, in one embodiment, the control system can prevent the operating line 230 to exceed the operating limit line 220. In addition, the corrected speed can be used to infer the pressure ratio at the operating limit line 220 for the particular corrected speed of interest. The pressure ratio limit is enforced on the operating pressure ratio to ensure adequate safety. In addition, noise and uncertainties in sensing the inlet temperature can lead to erroneous corrected speed computation which may lead to an erroneous pressure ratio limit being enforced, therefore, affecting the safe operation of the compressor 120 and the industrial gas turbine 110.

Pressure ratio sensing can also be a vital factor and relates to the control system uses sensors information to compute the operating pressure ratio. If the operating pressure ratio exceeds the pressure ratio limit, the control system can prevent any compromise to the safe operation of the industrial gas turbine. Uncertain pressure ratio sensing can affect the control system and the control of safe operation of the compressor 120 and the operation of the industrial gas turbine 110.

Variable stator vane setting can be a vital factor that relates to the uncertainty associated with how the stator vanes are set and tracked. The stator vane setting includes any uncertainty of setting the inlet guide vanes during manufacturing and any uncertainty associated with how the control system sets the stator vanes during operation.

Extraction flow variation can be a vital factor and is related to the variation in the amount of extraction flow that the industrial gas turbine 110 derives from the compressor 120 to cool various components downstream of the compressor 120. The extraction flow variation can also be dependent upon the variability in extraction port sizes.

Inlet temperature distortion can be a vital factor and relates to temperature non-uniformity in the compressor 120 inlet. Also, unscheduled transients can be a vital factor and relates to transient excursions of the operating line 230 towards the operating limit line 220 due to unscheduled events that occur during operation of the industrial gas turbine 110. In addition, fouling can be a vital factor and relates to the loss of compressor 120 performance and surge/stall capabilities due to fouling effects, such as, for example, particle accumulation, pitting, oil accumulation on the compressor 120 blade surfaces of the industrial gas turbine 120. Additionally, stall/surge line confidence can be a vital factor that relates to the level of confidence on stall/surge line 210 location from previous testing of the operation of the industrial gas turbine 110 and/or other data.

After the vital factors have been identified (step 320), a vital factor can be selected (step 330) and raw data relating to the vital factor can be provided (step 340). It should be appreciated that a user can select at least one of the vital factors (step 330) for which to provide the raw data (step 340). In addition, it should be appreciated that the user can also select more than one vital factor (step 330) and provide raw data for each of the vital factors selected (step 340). In one embodiment, providing the raw data (step 340) can be achieved by, for example, manually inputting data relating to the selected vital factors. In another embodiment, providing the raw data (step 340) can be achieved by retrieving raw data from sensor (not shown) that is connected to the industrial gas turbine 110. In yet another embodiment, providing the raw data (step 340) can be achieved by retrieving the raw data from a database and/or memory location.

After the raw data has been provided (step 340), the method 300 determines whether a transfer function exists for the vital factor (step 350). The transfer function evaluates the contribution of the vital factor to the determination of the stall/surge margin. If a transfer function exists (step 350), the existing transfer function is used and/or the existing transfer function is retrieved and then used (step 355) to calculate the contribution of the vital factor on the stall/surge margin. It should be appreciated that, in one embodiment, an existing transfer function for the vital factor could be programmed in the software or database program that executes the method 300, and the raw data is evaluated using the existing transfer function in the software or database program. It should also be appreciated that, in another embodiment, the existing transfer function could be located on an external computer or server. In this embodiment, the software or database program executing method 300 can provide the existing transfer function with the raw data for the vital factor, and the existing transfer function can evaluate the raw data externally from the software or database program. In addition, it should be appreciated that, in even another embodiment, the transfer function can exist on an external computer or server and the software or database program can retrieve the transfer function to evaluate the raw data of the vital factor. Also, it should be appreciated that various computing platforms that run various software and/or database programs on different platforms can be connected via software, such as, for example, an analysis server, that links the different platforms in such a way that the software and/or database programs running on various platforms can be utilized via a single package and/or software program. Additionally, the transfer functions that are located externally from the software or database program can be in a different programming language format, such as, for example, a C program or other computer programs in various programming languages and on various other platforms. The transfer functions that are in different programming languages or operating systems can be converted or interpreted by other conversion/interpretation programs so that the transfer function is compatible with the language or operating system of the software or database program executing the method 300.

If a transfer function does not exist (step 350), the method 300 determines if a transfer function is derivable (step 360). If a transfer function is derivable (step 360), the transfer function is derived (step 365). It should be appreciated that, in one embodiment, the software or database program that is executing the method 300 can be programmed to derive the transfer function. It should also be appreciated that, in another embodiment, the software or database program that executes the method 300 can provide the raw data to an external computer or server that contains a program that can derive the transfer function. In this embodiment, the raw data is provided to the external computer or server and the transfer function is derived and the raw data is evaluated by the derived transfer function by calculating the contribution of the vital factor to the stall/surge margin. Additionally, it should be appreciated that other programs may be required to connect the software or database executing the method 300. These other programs are required, for example, if the external computer or server operates uses a different computer language or operating system, such as, for example, a C program or other computer programs in various programming languages or on various other platforms.

If a transfer function is not derivable (step 360), the transfer function is approximated (step 370). The approximation of the transfer function involves evaluating the raw data along with providing educated guesses based on past experience that relate to the contribution of the vital factor to the stall/surge margin. After the transfer function has been approximated, the approximated transfer function is used to calculate the contribution of the vital factor on the stall/surge margin. Once the transfer function is either found to exist (step 355), derived (step 365) or approximated (step 370), these steps reach summing block 375. Once the transfer function is identified and used via one of the steps (steps 355, 365 and 370), the summing block 375 passes the information or data obtained from using the transfer function to a step of statistically analyzing the contribution of the vital factors on the stall/surge margin (step 380). The statistical analysis of the vital factors specifies each of the vital factors and statistically analyzes the contribution of each of the vital factors on the stall/surge margin. In one embodiment, the statistical analysis can use one or more statistical simulations, either individually or in combination, such as, for example, Monte Carlo Simulation, root-sum-squared simulation or worst case simulation. Also, the use of these statistical simulations can produce a database of statistical results. In addition, in another embodiment, the statistical analysis can present the statistical data in one or more data analysis format, such as, for example, pareto charts.

Once the contribution of the vital factors has been statistically analyzed (step 380), the stall/surge margin is allocated based on the results of the statistical analysis (step 390). The allocation of the stall/surge margin comprises determining a percentage or factor that the operating limit line 220 can be placed from the surge/stall line 210 to ensure safe operation of the industrial gas turbine 110. It should be appreciated that the statistical analysis of the contribution of the vital factors can be used to allocate a surge margin and/or a stall margin. The term stall/surge margin should be interpreted to encompass both a surge margin and/or a stall margin, and the allocation based on the statistical analysis can allocate a surge margin and/or a stall margin.

After the stall/surge margin has been allocated (step 390), an operating limit line 220 is defined from the allocated stall/surge margin (step 392). The operating limit line 220 is defined by placing the operating limit line 220 at the determined percentage or factor away from the stall/surge line 210. After the operating limit line 220 has been defined (step 392), the industrial gas turbine 110 is allowed to operate with the operating line 230 as close as possible to the operating limit line 220. In another representative embodiment, the stall/surge margin can be adjusted (step 394) based on the statistical analysis of the vital factors (step 380). It should be appreciated that adjusting of the stall/surge margin based on the statistical analysis can also include not changing the stall/surge margin. The adjustment of the stall/surge margin based on statistical analysis of the vital factors can be done in real time or can be done at various time intervals of operation of the industrial turbine system. Therefore, in one embodiment, the vital factors and, thus, the stall/surge margin can continually be monitored and adjusted as the industrial gas turbine 110 is operated. As such, the industrial gas turbine 110 can be adjusted during this operation based on the on-going evaluation of the stall/surge margin to maintain the highest operating efficiency without compromising safe operation of the industrial gas turbine 110. In one embodiment, the statistical analysis of the vital factors (step 380) and the adjustment of the stall/surge margin (step 394) allows the operation of the industrial gas turbine 110 to be no riskier than a user-selected risk level determined prior to the analysis.

The foregoing discussion of the invention has been presented for purposes of illustration and description. Further, the description is not intended to limit the invention to the form disclosed herein. Consequently, variations and modifications commensurate with the above teachings and with the skill and knowledge of the relevant art, are within the scope of the present invention. The embodiment described herein above is further intended to explain the best mode presently known of practicing the invention and to enable others skilled in the art to utilize the invention as such, or in other embodiments, and with the various modifications required by their particular application or uses of the invention. It is intended that the appended claims be construed to include alternative embodiments to the extent permitted by the prior art.

What is claimed is:

1. A method for evaluating stall/surge margin for a machine of interest, the method comprising:

identifying at least one vital factor wherein each of the at least one vital factor corresponds to operation of the machine of interest;

providing raw data relating to the at least one vital factor;

determining a contribution of the at least one vital factor to the stall/surge margin from at least the provided raw data;

statistically analyzing the contribution of the at least one vital factor to the stall/surge margin and creating a pareto chart of the at least one vital factor to the stall/surge margin;

allocating stall/surge margin based on the step of statistically analyzing; and defining an operating limit line based on the step of allocating.

2. The method of claim 1 further comprising the step of continually adjusting the stall/surge margin requirement during operation of the machine of interest based on the step of statistically analyzing.

3. The method of claim 1 further comprising the step of:

providing data relating to desired operating conditions of the machine of interest.

4. The method of claim 3 wherein the step of providing raw data comprises:

allowing a user to select at least one vital factor; and inputting the raw data relating to the at least one vital factor.

5. The method of claim 3 wherein the step of providing raw data comprises retrieving data relating to the at least one vital factor from at least one sensor attached to the machine of interest.

6. The method of claim 3 wherein the step of providing raw data comprises retrieving raw data relating to the at least one vital factor from a database.

7. The method of claim 1 wherein the step of determining a contribution of the at least one vital factor comprises calculating the contribution of the at least one vital factor to stall/surge margin using a transfer function for the at least one vital factor.

8. The method of claim 1 wherein the step of determining a contribution of the at least one vital factor comprises:

retrieving a transfer function for the at least one vital factor; and calculating the contribution of the at least one vital factor to the stall/surge margin using the retrieved transfer function.

9. The method of claim 1 wherein the step of determining a contribution of the at least one vital factor comprises:

deriving a transfer function for the at least one vital factor; and calculating the contribution of the at least one vital factor to the stall/surge margin using the derived transfer function.

10. A method for evaluating stall/surge margin for a machine of interest, the method comprising:

inputting data relating to desired operating conditions of the machine of interest;

identifying a plurality of vital factors wherein each of the plurality of vital factors corresponds to operation of the machine of interest;

selecting at least one of the plurality of vital factors;

providing raw data relating the selected at least one of the plurality of vital factors;

determining a contribution of the selected at least one of the plurality of vital factors to the stall/surge margin from at least the provided raw data and the input data related to the desired operating conditions of the machine of interest;

statistically analyzing the contribution of the plurality of vital factors to the stall/surge margin and creating a pareto chart of the plurality of vital factors to the stall/surge margin;

allocating stall/surge margin based on the step of statistically analyzing; and defining an operating limit line based on the step of allocating.

11. The method of claim 10 further comprising the step of continually adjusting the stall/surge margin during operation of the machine of interest according to the step of statistically analyzing.

12. The method of claim 10 wherein the step of determining a contribution of the selected at least one of the plurality of vital factors comprises calculating the contribution of the selected at least one of the plurality of vital factors to compressor stall/surge margin using a transfer function for the selected at least one of the plurality of vital factors.

13. The method of claim 10 wherein the step of determining a contribution of the selected at least one of the plurality of vital factors comprises:

retrieving a transfer function for the selected at least one of the plurality of vital factors; and calculating the contribution of the selected at least one of the plurality of vital factors to the stall/surge margin using the retrieved transfer function.

14. The method of claim 10 wherein the step of determining a contribution of the selected at least one of the plurality of vital factors comprises:

deriving a transfer function for the selected at least one of the plurality of vital factors; and calculating the contribution of the selected at least one of the plurality of vital factors to the stall/surge margin using the derived transfer function.

15. The method of claim 10 wherein the step of providing raw data comprises:

allowing a user to select at least one of the plurality of vital factors; and inputting the raw data relating to the selected at least one of the plurality of vital factors.

16. The method of claim 10 wherein the step of providing raw data comprises retrieving data relating to the selected at least one of the plurality of vital factors from at least one sensor attached to the machine of interest.

17. The method of claim 10 wherein the step of providing raw data comprises retrieving raw data relating to the selected at least one of the plurality of vital factors from a database.

18. The method of claim 10 wherein the step of statistically analyzing the contribution of the plurality of vital factors comprises performing a Monte Carlo simulation on the raw data.

19. The method of claim 10 wherein the plurality of vital factors are selected from the group consisting of: cold build-up clearance, tip loss, casing gauge, unit blade quality, inlet temperature sensing, pressure ratio sensing, variable stator vane setting, extraction flow variation, inlet temperature distortion, unscheduled transients, stall/surge line confidence and fouling.

20. A method for evaluating stall/surge margin for a machine of interest, the method comprising:

inputting data relating to desired operating conditions of the machine of interest;

identifying a vital factor corresponding to the operating of the machine of interest;

providing raw data relating to the vital factor;

determining a contribution of the vital factor to the stall/surge margin from at least the provided raw data and the input data related to the desired operating conditions of the machine of interest; and statistically analyzing the contribution of the vital factor to the stall/surge margin and creating a pareto chart with at least the vital factor to the stall/surge margin;

allocating stall/surge margin based on the step of statistically analyzing; and defining an operating limit line based on the step of allocating.

21. The method of claim 20 further comprising the step of continually adjusting the stall/surge margin during operation of the machine of interest according to the step of statistically analyzing.

22. A computer readable medium containing instructions for controlling a computer system to perform a method, the method comprising:

identifying at least one vital factor wherein each of the at least one vital factor corresponds to operation of the machine of interest;

providing raw data relating to the at least one vital factor;

determining a contribution of the at least one vital factor to the stall/surge margin from at least the provided raw data;

statistically analyzing the contribution of the at least one vital factor to the stall/surge margin and creating a pareto chart of the at least one vital factor to the stall/surge margin;

allocating stall/surge margin based on the step of statistically analyzing; and defining an operating limit line based on the step of allocating.

23. A computer readable medium containing instructions for controlling a computer system to perform a method, the method comprising:

inputting data relating to desired operating conditions of the machine of interest;

identifying a plurality of vital factors wherein each of the plurality of vital factors corresponds to operation of the machine of interest;

selecting at least one of the plurality of vital factors;

providing raw data relating the selected at least one of the plurality of vital factors;

determining a contribution of the selected at least one of the plurality of vital factors to the stall/surge margin from at least the provided raw data and the input data related to the desired operating conditions of the machine of interest;

statistically analyzing the contribution of the plurality of vital factors to the stall/surge margin and creating a pareto chart of the plurality of vital factors to the stall/surge margin;

allocating stall/surge margin based on the step of statistically analyzing; and defining an operating limit line based on the step of allocating.

* * * * *